US009884262B2

(12) United States Patent
Huey

(10) Patent No.: US 9,884,262 B2
(45) Date of Patent: Feb. 6, 2018

(54) BUBBLE GENERATING APPARATUS

(71) Applicant: Honor Metro Limited, Tortola (VG)

(72) Inventor: Marcus Huey, Pomona, CA (US)

(73) Assignee: Honor Metro Limited (VG)

( * ) Notice: Subject to any disclaimer, the term of this patent is extended or adjusted under 35 U.S.C. 154(b) by 130 days.

(21) Appl. No.: 14/534,243

(22) Filed: Nov. 6, 2014

(65) Prior Publication Data

US 2015/0133021 A1 May 14, 2015

Related U.S. Application Data

(60) Provisional application No. 61/901,945, filed on Nov. 8, 2013.

(51) Int. Cl.
*A63H 33/28* (2006.01)

(52) U.S. Cl.
CPC ..... *A63H 33/28* (2013.01)

(58) Field of Classification Search
CPC ..... A63H 33/28
USPC ..... 446/15, 16
See application file for complete search history.

(56) References Cited

U.S. PATENT DOCUMENTS 1,550,057 A * 8/1925 Beeler ..... A63H 33/28 261/120
2,225,702 A * 12/1940 Lyon, Jr. ..... A63H 33/28 124/56
2,249,608 A * 7/1941 Greene ..... F41B 9/0015 222/399
2,452,794 A * 11/1948 Saachy ..... A63H 33/28 40/408
2,547,825 A * 4/1951 King ..... A63H 33/28 40/408
2,579,714 A * 12/1951 Treuthart ..... A63H 33/28 40/408
2,632,281 A * 3/1953 Schmidt, Jr. ..... A63H 33/28 40/408
2,669,059 A * 2/1954 McNeill ..... A63H 33/28 40/408
2,736,988 A * 3/1956 Fisher ..... A63H 33/28 446/17
2,832,173 A * 4/1958 Winfield ..... A63H 33/28 273/349
2,974,438 A * 3/1961 Hopkins ..... A63H 33/28 446/16

(Continued)

FOREIGN PATENT DOCUMENTS

CN 3621791 3/2007
CN 201067639 6/2008

*Primary Examiner* — Melba Bumgarner
*Assistant Examiner* — Joseph B Baldori
(74) *Attorney, Agent, or Firm* — Belles Katz LLC

(57) ABSTRACT

A bubble generating apparatus includes an air flow generator, a liquid tray defined by a floor and sidewalls and having one or more bubble forming ports therein, and a pivot arm coupled to a motor for pivoting the pivot arm about an axis so that during pivoting a bubble generating member of the pivot arm passes over one of the bubble forming ports, the air flow generator positioned to direct an air stream through the one or more bubble forming ports, and a gravity feed liquid reservoir, wherein the liquid tray is configured to generate bubbles from the liquid when the air flow generator directs the air stream through the one or more bubble forming ports while the pivot arm pivots about the axis.

16 Claims, 14 Drawing Sheets

(56) References Cited

U.S. PATENT DOCUMENTS 3,604,144 A * 9/1971 Span ..... A63H 33/28 446/17
4,016,673 A * 4/1977 Constance ..... A63H 33/28 446/18
4,044,496 A * 8/1977 Jernstrom ..... A63H 33/28 446/16
4,045,049 A * 8/1977 Schultz ..... A63H 33/28 273/399
4,098,431 A * 7/1978 Palmer ..... G03D 3/065 222/143
4,133,138 A * 1/1979 Coons ..... A63H 33/28 446/16
4,299,049 A * 11/1981 Pimentel ..... A63H 33/28 446/15
4,764,141 A * 8/1988 D'Andrade ..... A63H 33/28 446/16
4,775,348 A * 10/1988 Collins ..... A63H 33/28 446/15
5,238,437 A * 8/1993 Vowles ..... A63H 33/28 446/15
5,542,869 A * 8/1996 Petty ..... A63H 33/28 446/16
6,200,184 B1 * 3/2001 Rich ..... A63H 33/28 446/15
6,328,286 B1 * 12/2001 Sanchez ..... A63H 33/28 261/30
6,450,851 B1 * 9/2002 Rehkemper ..... A63H 33/28 446/15
6,659,830 B2 * 12/2003 Thai ..... A63H 33/28 446/15
6,786,251 B2 * 9/2004 Nadel ..... A63H 33/28 141/98
6,820,662 B2 * 11/2004 Crawford ..... A63H 33/28 141/198
RE39,443 E * 12/2006 Schramm ..... B65D 23/00 141/311 A
8,123,584 B2 * 2/2012 Thai ..... A63H 33/28 446/15
8,272,915 B2 9/2012 Thai
8,272,916 B2 9/2012 Thai
8,795,020 B2 * 8/2014 Lin ..... A63H 33/28 446/19
9,050,543 B2 * 6/2015 Barish ..... A63H 33/28
9,339,737 B2 * 5/2016 Chan ..... A63H 33/28
2008/0274662 A1 * 11/2008 Lo ..... A63H 33/28 446/16
2009/0124161 A1 * 5/2009 Barish ..... F41B 9/004 446/15
2012/0220184 A1 * 8/2012 Orem ..... A63H 33/28 446/16

* cited by examiner

BUBBLE GENERATING APPARATUS

CROSS-REFERENCE TO RELATED APPLICATIONS

The present application claims priority to U.S. Provisional Patent Application Ser. No. 61/901,945, filed on Nov. 8, 2013, the entirety of which is incorporated herein by reference.

FIELD OF THE INVENTION

The present invention relates to apparatuses for generating bubbles and methods of generating bubbles.

BACKGROUND OF THE INVENTION

Children love bubbles and the bubble makers that are used to create them. At least as far as children are concerned, there is a general understanding that the more bubbles that are made and the quicker they are made, the better the bubble maker. Simple wands that produce bubbles by loading the wands with a bubble solution and blowing through the wands with air from a person's mouth are well known. Furthermore, certain types of automated bubble producing devices, such as bubble producing guns, are also known. However, these types of devices can make a terrible mess in the hands of a child (the same goes for some adults, too). For purposes of generating more bubbles, and making less of a mess, stand-alone bubble generating toys have been designed. Such a toy generates bubbles by forming a film of bubble solution using an applicator as the solution streams through bubble-forming openings. This type of bubble generating toy requires bubble solution to be pumped from a reservoir at the base of the assembly and streamed over the bubble-forming openings. Furthermore, excess bubble solution must be collected so that it can be directed back into the reservoir. Toys of this type also blow air through small air tubes, which direct the air to the bubble-forming openings to help form the bubbles.

Existing automated bubble making devices must run for a period of time before any bubbles are created, thus leading users to become bored while waiting for the production of bubbles. Furthermore, existing automated bubble making devices are messy, difficult and expensive to manufacture, and difficult to use. Thus, a need exists for an apparatus for generating bubbles which overcomes the above-noted deficiencies.

SUMMARY OF THE INVENTION

The present invention is directed toward a bubble generating apparatus which includes an air flow generator positioned to direct air through one or more bubble forming ports. A film is formed from a liquid over the bubble forming ports so that the action of the blowing air forms bubbles from the film of the bubble solution.

In a first separate aspect of the present invention, the bubble generating apparatus includes a housing comprising a liquid tray defined by a floor and a sidewall extending upwardly from the floor; a motor; an air flow generator operably coupled to the motor to generate an air stream; a plurality of bubble forming ports located in the liquid tray, each of the bubble forming ports comprising an upstanding wall that surrounds an opening, the air flow generator positioned to direct the air stream through the openings of the one or more bubble forming ports; a first pivot arm located within the liquid tray and operably coupled to the motor to pivot the first pivot arm about a first axis, the first pivot arm comprising at least one bubble generating member that passes over a first one of the bubble forming ports during pivoting of the first pivot arm about the first axis to generate bubbles from a bubble solution retained in the liquid tray; and a second pivot arm located within the liquid tray and operably coupled to the motor to pivot the second pivot arm about a second axis, the second pivot arm comprising at least one bubble generating member that passes over a second one of the bubble forming ports during pivoting of the second pivot arm about the second axis to generate bubbles from the bubble solution retained in the liquid tray.

In a second separate aspect of the present invention, the bubble generating apparatus includes a housing comprising a liquid tray defined by a floor and a sidewall extending upwardly from the floor; a motor; an air flow generator operably coupled to the motor to generate an air stream; first and second bubble forming ports located in the liquid tray, the first bubble forming port comprising a first upstanding wall extending upwardly from the floor of the liquid tray and a first opening and the second bubble forming port comprising a second upstanding wall extending upwardly from the floor of the liquid tray and a second opening, the air flow generator positioned to direct the air stream through the first and second openings of the first and second bubble forming ports; and a first pivot arm located within the liquid tray and operably coupled to the motor to pivot the first pivot arm about a first axis, the first pivot arm comprising a first bubble generating member that passes over the first bubble forming port and a second bubble generating member that passes over the second bubble forming port during pivoting of the first pivot arm about the first axis to generate bubbles from a bubble solution retained in the liquid tray.

In a third separate aspect of the present invention, the bubble generating apparatus includes a motor; an air flow generator operably coupled to the motor to generate an air stream; a liquid tray defined by a floor and a sidewall, a volume of a bubble solution at least partially filling the liquid tray; one or more bubble forming ports and one or more air ports located within the liquid tray; the air flow generator positioned to direct the air stream through the one or more bubble forming ports and through the one or more air ports; and a first pivot arm comprising one or more bubble generating members, the first pivot arm operably coupled to the motor to pivot the first pivot arm about a first axis so that each bubble generating member of the first pivot arm pivots over one of the bubble forming ports.

In a fourth separate aspect of the present invention, any of the foregoing aspects may be employed in combination.

Accordingly, an improved bubble generating apparatus is disclosed. Advantages of the improvements will be apparent from the drawings and the description of the preferred embodiment.

BRIEF DESCRIPTION OF THE DRAWINGS

The foregoing summary, as well as the following detailed description of the exemplary embodiments, will be better understood when read in conjunction with the appended drawings. It should be understood, however, that the invention is not limited to the precise arrangements and instrumentalities shown in the following figures.

DETAILED DESCRIPTION OF THE INVENTION

Figure 1:
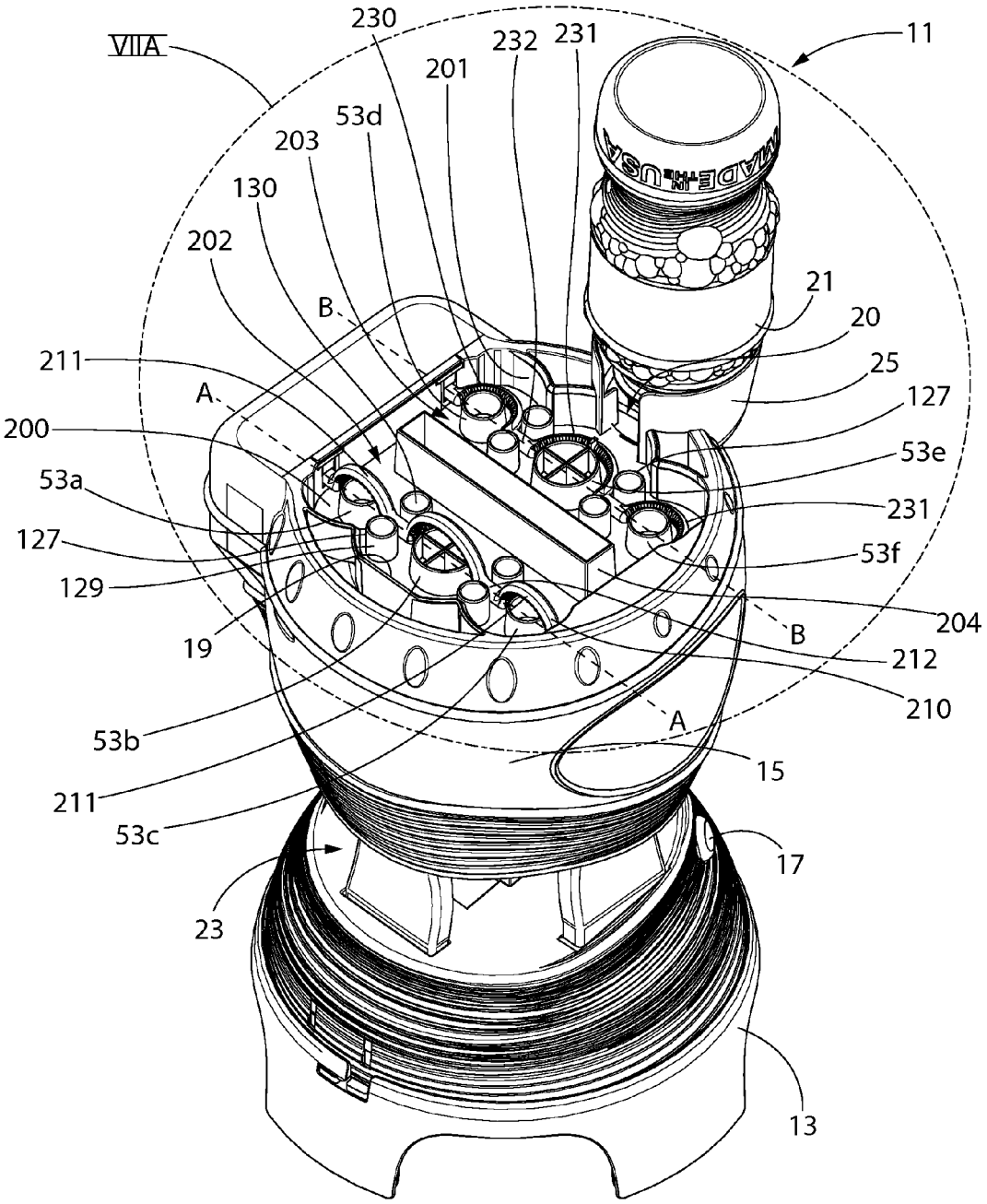
FIG. 1 is a perspective view of a bubble generating apparatus.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 6A:
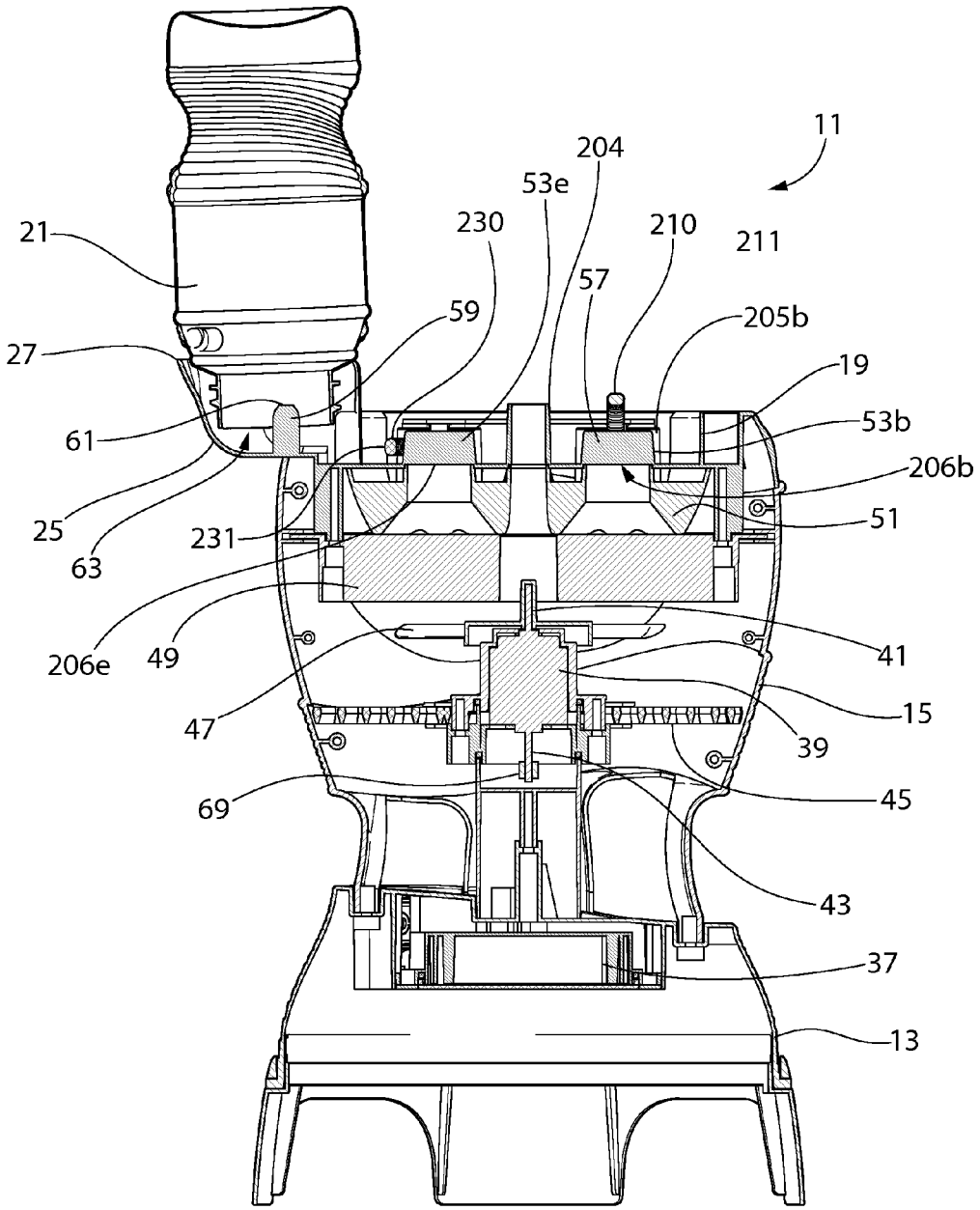
FIG. 6A is a sectional view of the bubble generating apparatus along the lines VIA-VIA of FIG. 5.

Referring first to FIGS. 1 and 6A concurrently, a bubble generating apparatus 11 will be described in accordance with an embodiment of the present invention. The bubble generating apparatus 11 includes a lower base housing 13 and an upper body housing 15 that are coupled together to collectively form a housing of the bubble generating apparatus 11. The lower base housing 13 may be formed integrally with the upper body housing 15 or as separate components that are coupled together by mechanical means such as screws, fasteners, or the like. As described in more detail below, a pushbutton on/off switch 17 and a power source 37, such as one or more batteries, is disposed in the lower base housing 13. A motor 39 and bubble generating mechanisms are disposed in or otherwise coupled to the upper body housing 15. The on/off switch 17 controls actuation of the motor 39 to begin bubble generation as will be described in more detail below. The upper body housing 15 also includes a liquid tray 19 to hold bubble solution supplied through a bottle 21, which serves as a solution reservoir. The bottle 21 may be used to pour bubble solution into the liquid tray 19 by hand as needed, or as described in detail below, the bottle 21 may be inverted and used to gravity feed bubble solution into the liquid tray 19.

Figure 3:
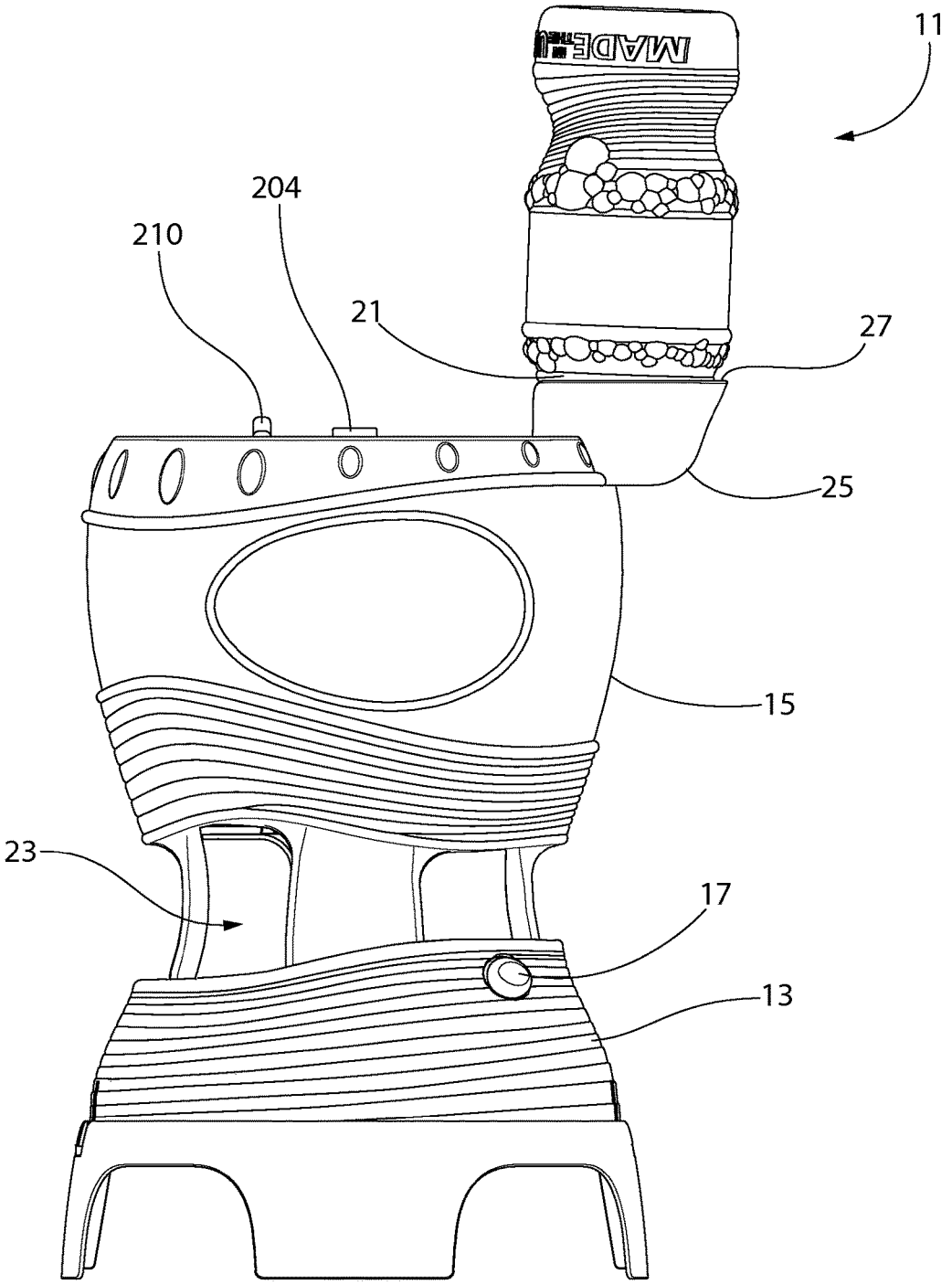
FIG. 3 is a first side elevation view of the bubble generating apparatus of FIG. 1.
Figure 4:
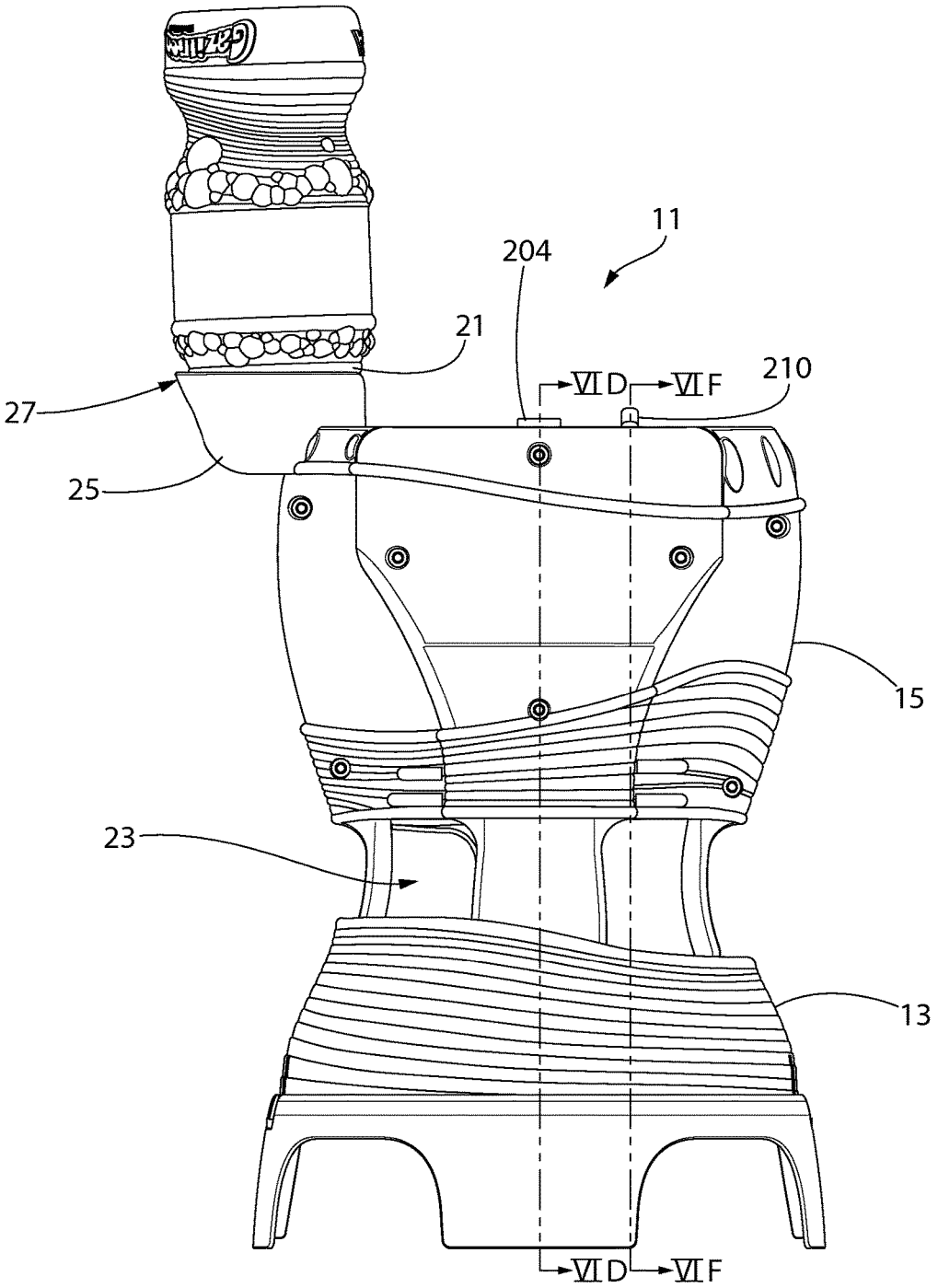
FIG. 4 is a second side elevation view of the bubble generating apparatus of FIG. 1.
Figure 5:
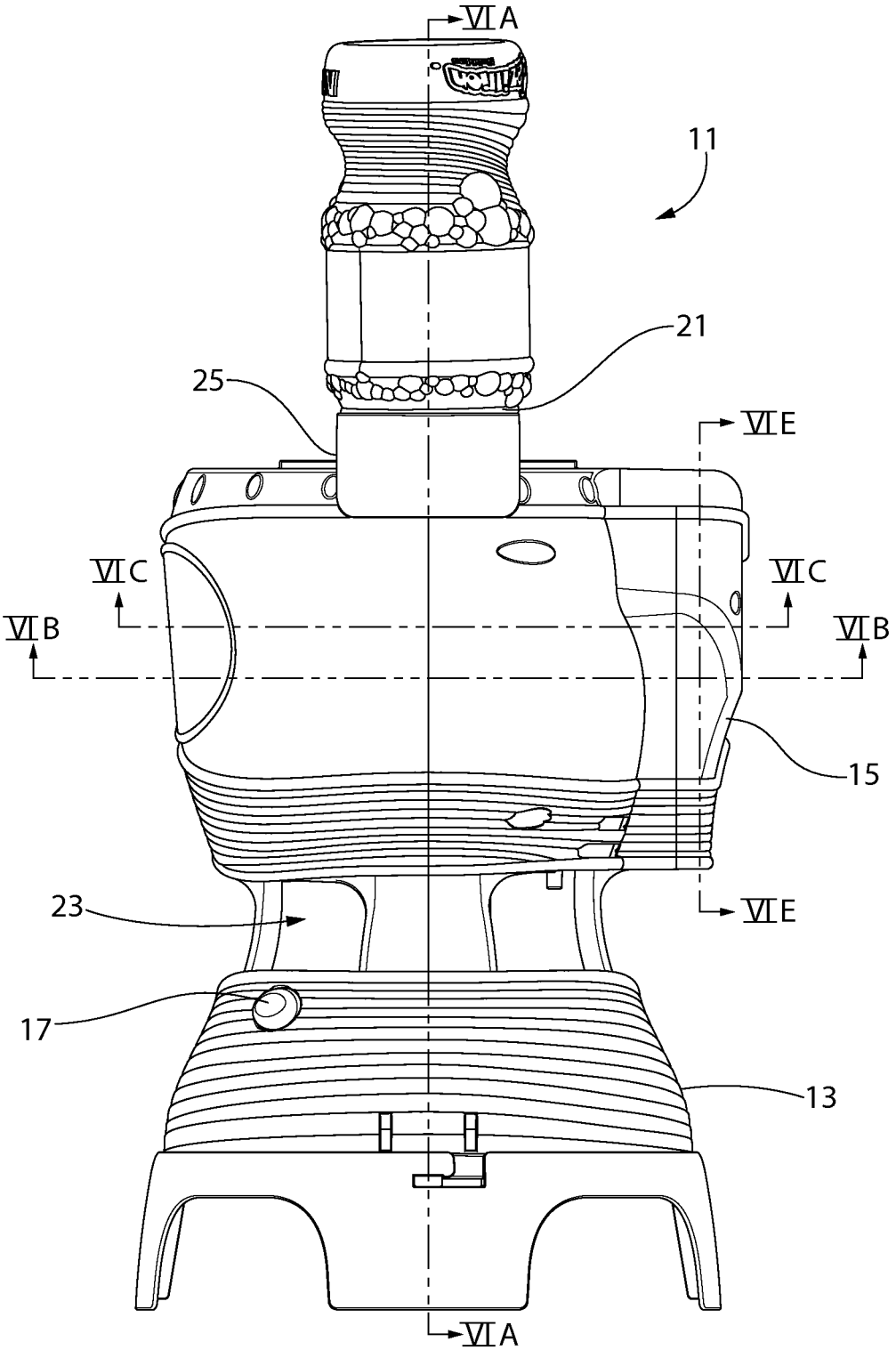
FIG. 5 is a third side elevation view of the bubble generating apparatus of FIG. 1.

Referring briefly to FIGS. 3-5, FIG. 3 shows the front side of the bubble generating apparatus 11, insofar as the side shown includes the on/off switch 17, FIG. 4 shows the back side of the bubble generating apparatus 11, and FIG. 5 shows a third side of the bubble generating apparatus 11. Several vent ports 23 are included between the lower base housing 13 and the upper body housing 15, and air is drawn through the vent ports 23 for bubble generation. In the exemplified embodiments, the bottle 21 is in an inverted position in a reservoir receptacle 25, which extends outward from the upper body housing 15. The reservoir receptacle 25 is fluidly coupled to the liquid tray 19 through a passageway 20 to directly feed bubble solution from the bottle 21 into the liquid tray 19 so that bubble solution placed into the reservoir receptacle 25 drains from the bottle 21 through the passageway 20 and into the liquid tray 19. The liquid tray 19, the reservoir receptacle 25, and the bottle 21 are configured so that the bottle 21 acts as a gravity feed for bubble solution into the liquid tray 19. By having the bubble solution gravity fed into the tray, the need for a pump and a collection tray for excess and/or unused bubble solution are eliminated. The top outer edge 27 of the reservoir receptacle 25 is shaped to form a pour spout, so that when the bubble generating apparatus 11 is finished being used, the bubble solution left in the liquid tray 19 may be easily poured back into the bottle 21.

Figure 2:
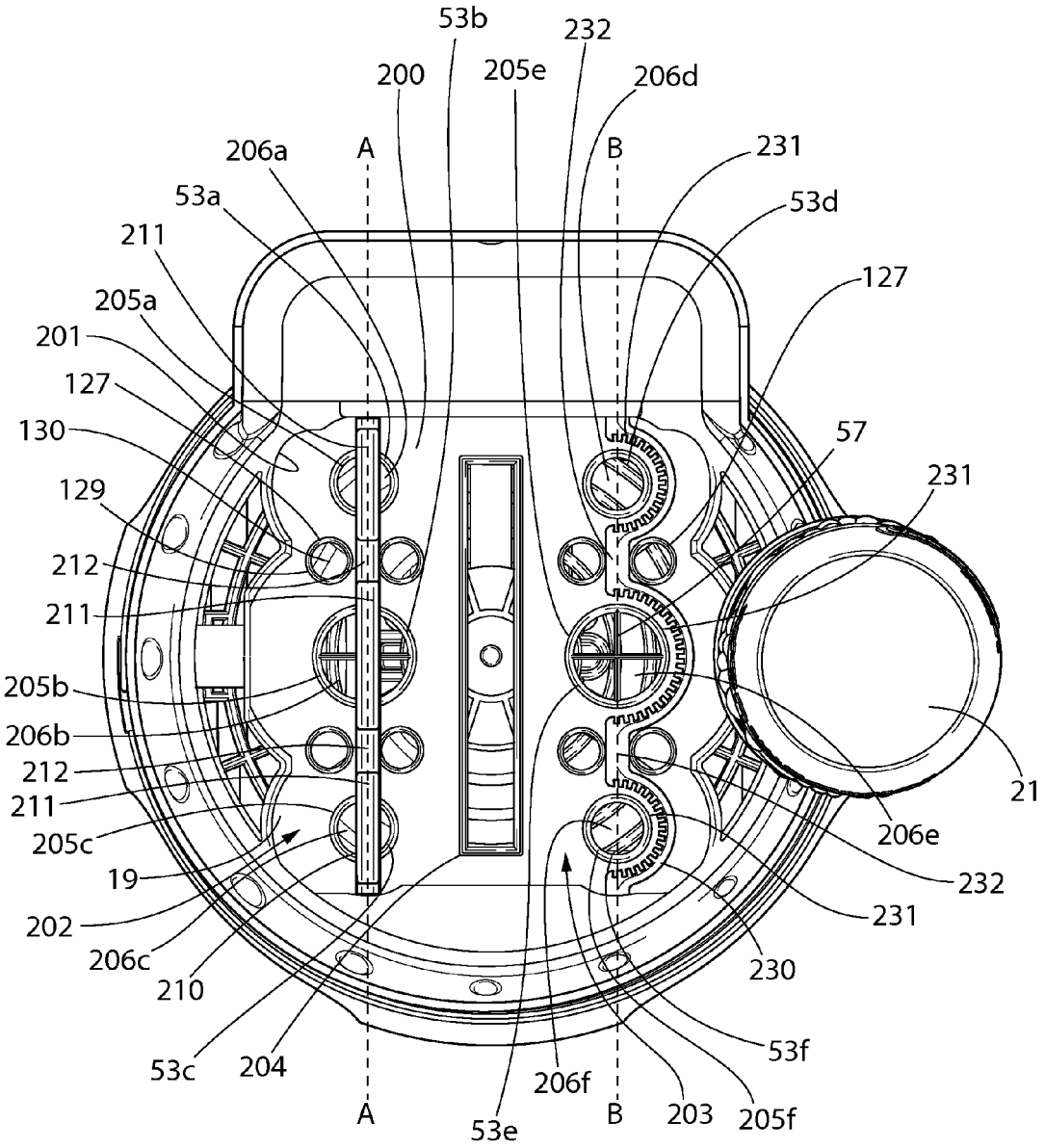
FIG. 2 is a top side elevation view of the bubble generating apparatus of FIG. 1.

Referring now to FIGS. 1 and 2 concurrently, the details of the components that work in conjunction to form bubbles will be described. An open top end of the upper body housing 15 comprises the liquid tray 19. Specifically, the liquid tray 19 is defined by a floor 200 and a sidewall 201 extending upwardly from the floor 200. Collectively, the floor 200 and the sidewall 201 form a reservoir within which a bubble solution can be held when the bubble generating apparatus 11 is used to form bubbles as described herein. Thus, bubble solution can fill the liquid tray 19 up to the top edges of the sidewall 201 without overflowing the liquid tray 19.

In the exemplified embodiment, the liquid tray 19 is separated into a first section 202 and a second section 203 by a divider wall 204 that extends upwardly from the floor 200 of the liquid tray 19. The divider wall 204 is exemplified as a rectangular shaped wall but may take on other shapes in other embodiments. Furthermore, in the exemplified embodiment the divider wall 204 surrounds an opening that enables air to flow therethrough (air generated by an air generator as discussed below), but the divider wall 204 may be a flat planar wall in other embodiments and the opening may be omitted. In the exemplified embodiment, the divider wall 204 is located centrally within the liquid tray 19 and is not coupled to any portion of the sidewall 201 of the liquid tray 19. However, the invention is not to be so limited in all embodiments and the divider wall 204 may be coupled to a portion of the sidewall 201 in other embodiments. Because the divider wall 204 is spaced apart from the sidewall 201 in the exemplified embodiment, the first and second sections 202, 203 of the liquid tray 19 are in fluid communication with one another. Thus, bubble solution that enters into one of the first and second sections 202, 203 of the liquid tray 19 can readily flow into the other one of the first and second sections 202, 203 of the liquid tray 19 by flowing around the divider wall 204.

The bubble generating apparatus 11 further comprises a plurality of bubble forming ports 53*a-f*. More specifically, the bubble forming ports 53*a-c* are located in the first section 202 of the liquid tray 19 and the bubble forming ports 53*d-f* are located in the second section of the liquid tray 19. Although six bubble forming ports 53*a-f* are illustrated in the exemplified embodiment, more or less than six bubble forming ports 53*a-f* can be used in other embodiments. Each of the bubble forming ports 53*a-f* comprises an upstanding wall 205*a-f* and an opening 206*a-f* such that the upstanding wall 205*a-f* of each bubble forming port 53*a-f* surrounds its respective opening 206*a-f*. Furthermore, each of the openings 206*a-f* extends through the floor 200 of the liquid tray 19 (see FIGS. 6A and 6F) so that an air stream generated by an air flow generator located beneath the floor 200 (such as air flow generator 47 depicted in FIG. 6A and described in more detail below) flows through each of the openings 206*a-f* to assist in bubble generation.

The upstanding walls 205*a-f* serve to prevent the bubble solution or other liquid from entering into the openings 206*a-f* of the bubble forming ports 53*a-f*. Thus, as the bubble solution fills the liquid tray 19, the bubble solution will abut against the upstanding walls 205*a-f* but will not enter into the openings 206*a-f*, thereby keeping the bubble solution away from the electronic components of the bubble generating apparatus 11 that are located within the housing. As will be appreciated from the description of the function of the bubble generating apparatus 11 below with reference to FIGS. 7A-7C, an air flow generator 47 is operably coupled to the motor 45 to cause the air flow generator 47 to generate an air stream through the openings 206*a-f* of the bubble forming ports 53*a-f*. When an air stream flows through the openings 206*a-f* as the bubble solution is being carried over the bubble forming ports 53*a-f*, bubbles are created from the bubble solution.

In the exemplified embodiment, two of the bubble forming ports 53*b*, 53*e* further comprise air flow guides 57 that divide the respective openings 206*b*, 206*e* into multiple openings. The air flow guides 57 thus serve to facilitate the generation of multiple bubbles at each of the bubble forming ports 53*b*, 53*e*. In the exemplified embodiment the air flow guides 57 divide the openings 206*b*, 206*e* into four openings. Of course, the openings 206*b*, 206*e* can be divided into two openings or more than four openings in other embodiments. Furthermore, although only two of the bubble forming ports 53*b*, 53*e* are illustrated with air flow guides 57, any of one or more (or none) of the bubble forming ports 53*a-f* may include air flow guides 57 in other embodiments.

In addition to the bubble forming ports 53*a-f*, the bubble generating apparatus 11 also comprises air ports 127. Each of the air ports 127 comprises an upstanding air wall 129 and an air opening 130 that is surrounded by the upstanding air wall 129. The air opening 130 also extends through the floor 200 of the liquid tray 19 so that the air stream generated by the air flow generator 47 will flow/stream through the air ports 127 in addition to through the bubble forming ports 53*a-f*. However, the bubble solution will not be carried over the air ports 127, and thus the air ports are not used for bubble formation. Rather, the air ports 127 (only some of which are labeled in the drawings in an effort at avoiding clutter) provide extra turbulence for the bubbles being formed. Specifically, due to the proximity of the air ports 127 to the bubble forming ports 53*a-f*, the air streaming through the air ports 127 causes a turbulent flow of the bubbles generated at the various bubble forming ports 53*a-f*.

The bubble generating apparatus 111 also comprises a first pivot arm 210 and a second pivot arm 230 that are operably coupled to the motor 39. The first pivot arm extends along a first axis A-A and the second pivot arm 230 extends along a second axis B-B. Furthermore, the first pivot arm 210 pivots about the first axis A-A during operation of the motor 39 and the second pivot arm 230 pivots about the second axis B-B during operation of the motor 39. More specifically and as will be described in more detail below with reference to FIGS. 7A-7C, each of the first and second pivot arms 210, 230 pivots back and forth (i.e., oscillates) about a 180° arc.

As can be seen, the first and second axes A-A, B-B are substantially parallel to one another in the exemplified embodiment. Furthermore, the first axis A-A is spaced apart from the second axis B-B along the width of the liquid tray 19. Furthermore, as described in more detail below with reference to FIGS. 7A-7C, the first pivot arm 210 pivots about the first axis A-A independently of the second pivot arm 230 pivoting about the second axis B-B. Thus, the first and second pivot arms 210, 230 may pivot at different speeds, one may pivot without the other, and they may pivot synchronously like windshield wipers or asynchronously as desired.

In the exemplified embodiment, the first pivot arm 210 comprises three bubble generating members 211 and the second pivot arm 230 comprises three bubble generating members 231. Of course, the invention is not to be so limited in all embodiments and each of the first and second pivot arms can have more or less than three bubble generating members 211, 231 in other embodiments. Furthermore, the first pivot arm 210 comprises an arm section 212 extending between each pair of adjacent bubble generating members 211 and the second pivot arm 230 comprises an arm section 232 extending between each pair of adjacent bubble generating members 231. Each of the bubble generating members 211 is aligned with one of the bubble forming ports 53*a-c* and each of the bubble generating members 231 is aligned with one of the bubble forming ports 53*d-f*. The arm sections 212 are located between adjacent ones of the bubble forming ports 53*a-c* and are transversely aligned with some of the air ports 127. Similarly, the arm sections 232 are located between adjacent ones of the bubble forming ports 53*d-f* and are transversely aligned with some of the air ports 127.

In the exemplified embodiment, each of the bubble generating members 211, 231 is an arcuate shaped member, and more specifically has a semi-circle or half-circle shape. Other shapes and geometries for the bubble generating members 210, 230 may be used, although the use of other shapes or geometries may require the bubble forming ports 53*a-f* to have a different design or shape than the cylindrical/circular shape which is shown in the figures. In the exemplified embodiment, as the first and second pivot arms 210, 230 pivot about the 180° arc, the bubble generating members 211, 231 in the 0° and 180° positions collectively forms an enclosed circle which facilitates the generation of bubbles from the bubble solution. Each of the bubble generating members 211, 231 has an inner concave surface that faces one of the bubble forming ports 53*a-f* and an outer convex surface. Furthermore, in the exemplified embodiment the inner concave surfaces of the bubble generating members 211, 231 have ribs or channel features that assist the bubble generating members 211, 231 in carrying the bubble solution thereon. In the exemplified embodiment the outer convex surfaces of the bubble generating members 211, 231 are smooth and free of ribs/channels, but may include such ribs/channels in other embodiments.

As noted above, the first pivot arm 210 extends along the first axis A-A. More specifically, the arm sections 212 of the first pivot arm 210 are positioned on the first axis A-A and the bubble generating members 211 are offset from the first axis A-A. Moreover, as exemplified the bubble forming ports 53*a-c* are positioned on the first axis A-A and the air ports 127 are offset from the first axis A-A. More specifically, in the exemplified embodiment there are two transversely aligned air ports 127 positioned between each adjacent pair of bubble forming ports 53*a-c* (two air ports 127 between the bubble forming ports 53*a*, 53*b* and two air ports 127 between the bubble forming ports 53*b*, 53*c*). The two air ports 127 between each adjacent pair of bubble forming ports 53*a-c* are positioned on opposite sides of the first axis A-A and on opposite sides of one of the arm sections 212 of the first pivot arm 210.

Similarly, the second pivot arm 230 extends along the second axis B-B. More specifically, the arm sections 232 of the second pivot arm 230 are positioned on the second axis B-B and the bubble generating members 231 are offset from the second axis B-B. Moreover, as exemplified the bubble forming ports 53*d-f* are positioned on the second axis B-B and the air ports 127 are offset from the first axis B-B. More specifically, in the exemplified embodiment there are two transversely aligned air ports 127 positioned between each adjacent pair of bubble forming ports 53*d-f* (two air ports 127 between the bubble forming ports 53*d*, 53*e* and two air ports 127 between the bubble forming ports 53*e*, 53*f*). The two air ports 127 between each adjacent pair of bubble forming ports 53*d-f* are positioned on opposite sides of the second axis B-B and on opposite sides of one of the arm sections 232 of the second pivot arm 230.

Referring to FIG. 6A, the details of the internal components of the bubble generating apparatus 11 will be further described. The power source 37, such as the one or more batteries, is stored within a battery compartment located in the lower base housing 13. Conductors (not shown) in the battery compartment operatively connect the on/off switch 17 to the motor 39, so that when the switch 17 is actuated, the motor 39 is energized and the bubble generating apparatus 11 begins generating bubbles, assuming bubble solution is present in the liquid tray 19. The motor 39 includes two drive shafts 41, 43 and is disposed in the upper body housing 15 above a protective grating 45. The first drive shaft 41 extends upward and is operatively coupled to the air flow generator 47. The motor 39 is also operably coupled to the first and second pivot arms 210, 230 for driving pivoting of the first and second pivot arms 210, 230 as described below. Thus, when the motor 39 is energized the air flow generator 47 generates air and the first and second pivot arms 210, 230 pivot as described herein. The combination of the air stream generated by the air flow generator 47 and the pivoting movement of the first and second pivot arms 210, 230 results in the generation of bubbles, as described in more detail below with reference to FIGS. 7A-7C.

Figure 6B:
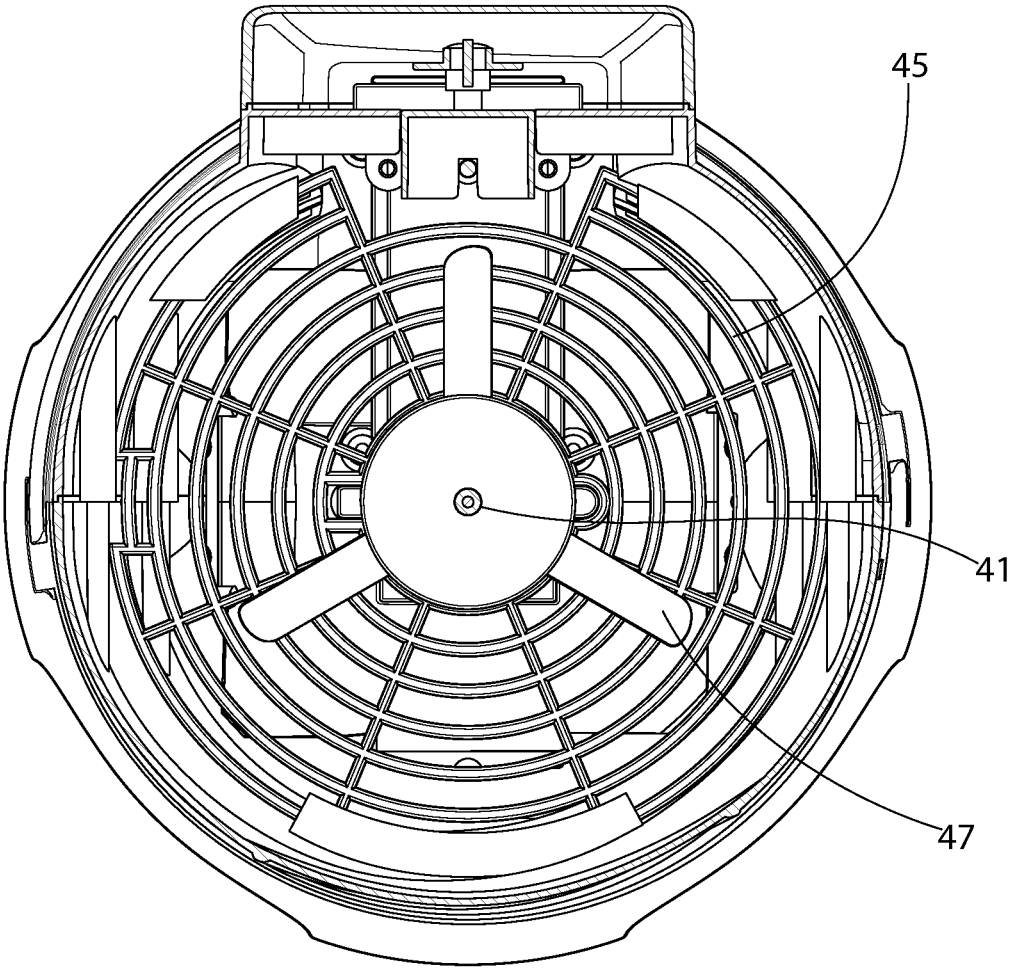
FIG. 6B is a sectional view of the bubble generating apparatus along the lines VIB-VIB of FIG. 5.
Figure 6C:
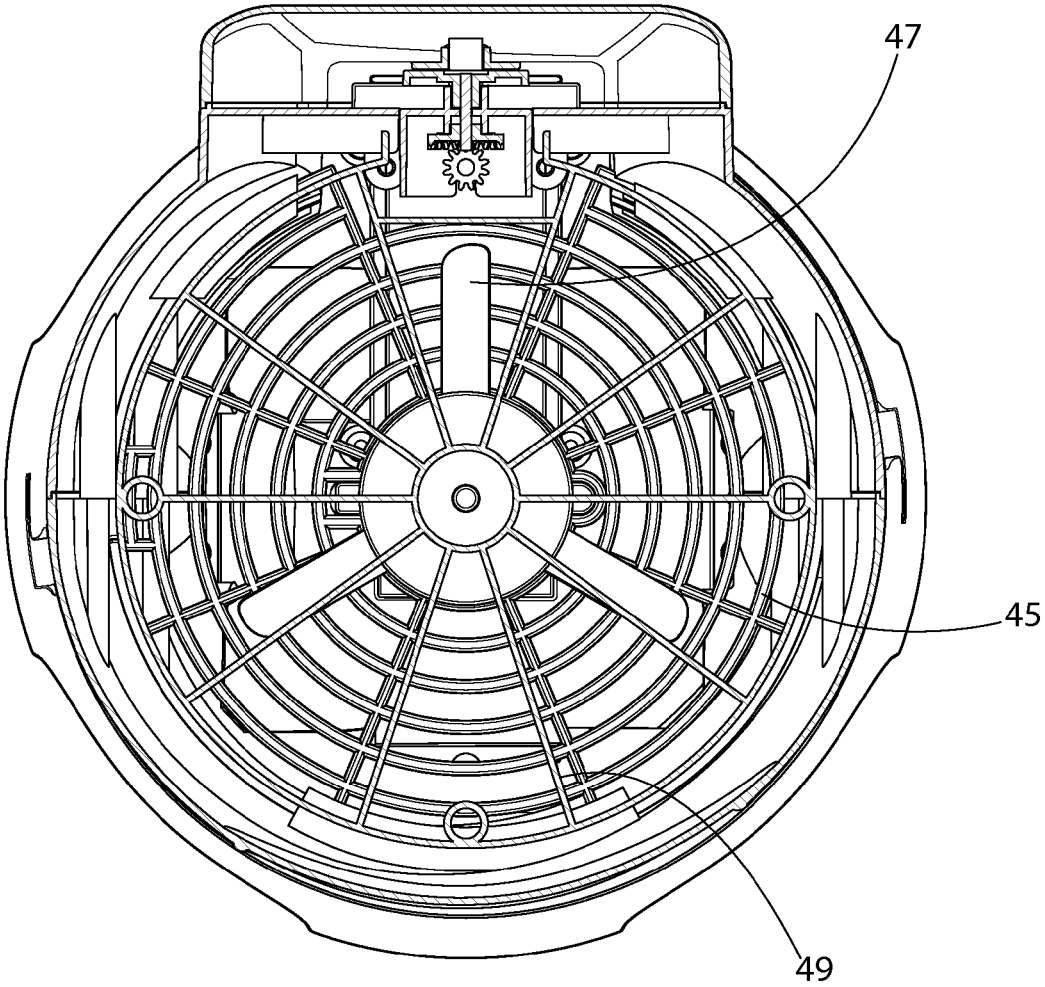
FIG. 6C is a sectional view of the bubble generating apparatus along the lines VIC-VIC of FIG. 5.

In the exemplified embodiment, the air flow generator 47 is a fan or fan blades such that during rotation of the air flow generator 47 (or fan device) due to its operable coupling to the motor 39, the fan blades generate an air stream. However, the invention is not to be so limited and the air flow generator 47 can be any other device capable of generating an air stream for bubble production as discussed herein. In the exemplified embodiment, the air flow generator 47 is configured to draw air in from the vent ports 23 and direct the air upward through the liquid tray 19. The air stream that flows upward towards the liquid tray 19 flows through the openings 206*a-f* of the bubble forming ports 53*a-f*, through the openings 130 of the air ports 127, and through any other openings that are formed into the floor 200 of the liquid tray 19. The air flow generator 47 sitting above the protective grating 45 can be seen in FIG. 6B. An air flow guide 49 is disposed above the air flow generator 47, and this air flow guide 49 aids in creating a more even flow of air from the air flow generator 47 up into the underside of the liquid tray 19. The air flow guide 49 can be seen disposed above the air flow generator 47 in FIG. 6C.

The underside of the liquid tray 19 includes constricting inlets 51, which are shaped as truncated cones, and each constricting inlet 51 directs the air flow from the air flow generator 47 into one of the bubble forming ports 53*a-f* (and specifically through the openings 206*a-f* of the bubble forming ports 53*a-f*). Although it is desirable in certain embodiments to have each bubble forming port 53*a-f* associated with a constricting inlet, such is not necessary. At minimum, each bubble forming port 53*a-f* should have a clear pathway leading from the air flow generator 47 through the openings 206*a-f* so that air can pass through the openings 206*a-f* of the bubble forming ports 53*a-f* and help generate bubbles. The constricting inlets 51 extend to a hole in the floor 200 of the liquid tray 19 for the bubble forming ports 53*a-f*, each hole forming a part of one of the openings 206*a-f* of the bubble forming ports 53*a-f*.

Figure 6D:
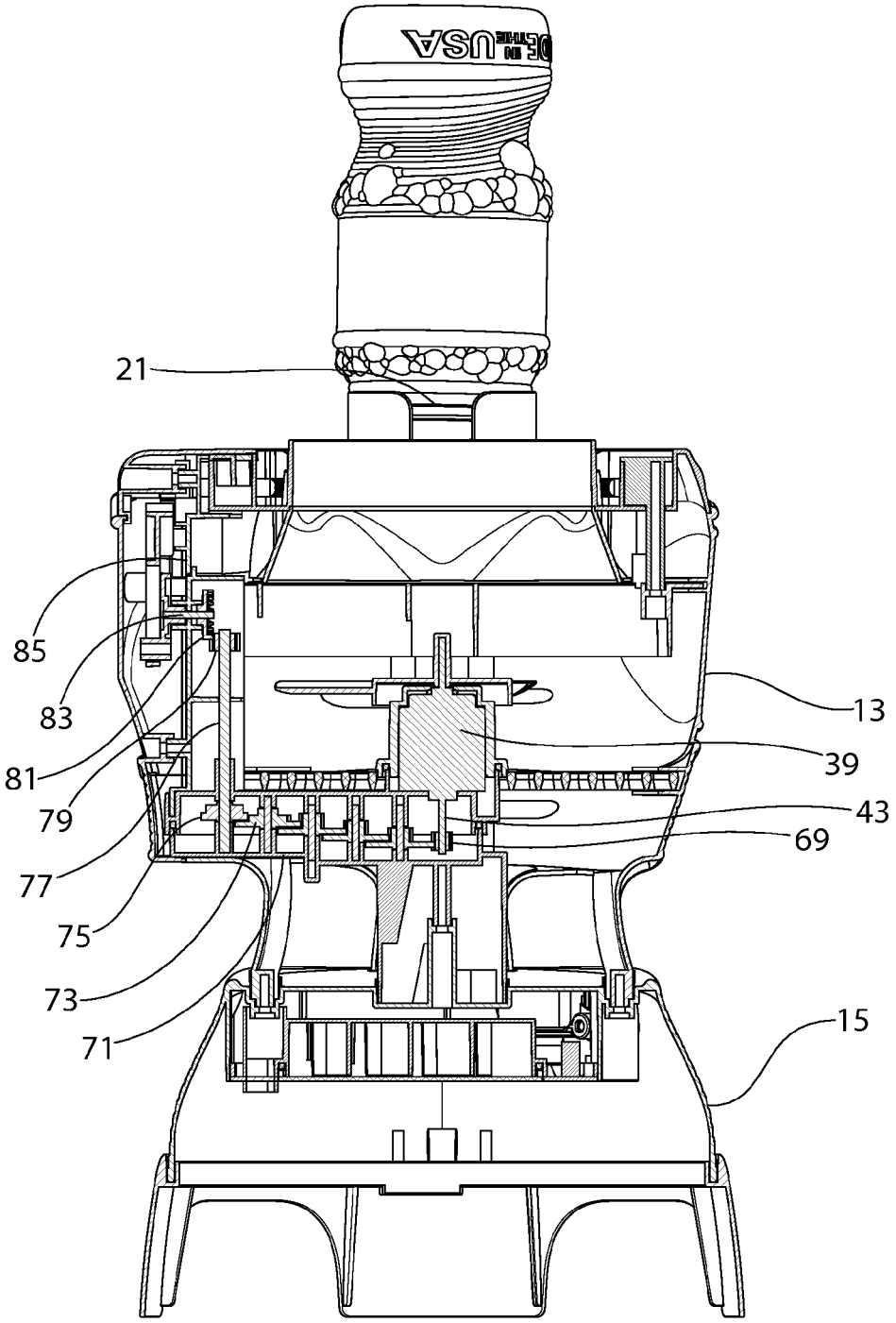
FIG. 6D is a sectional view of the bubble generating apparatus along the lines VID-VID of FIG. 4.
Figure 6E:
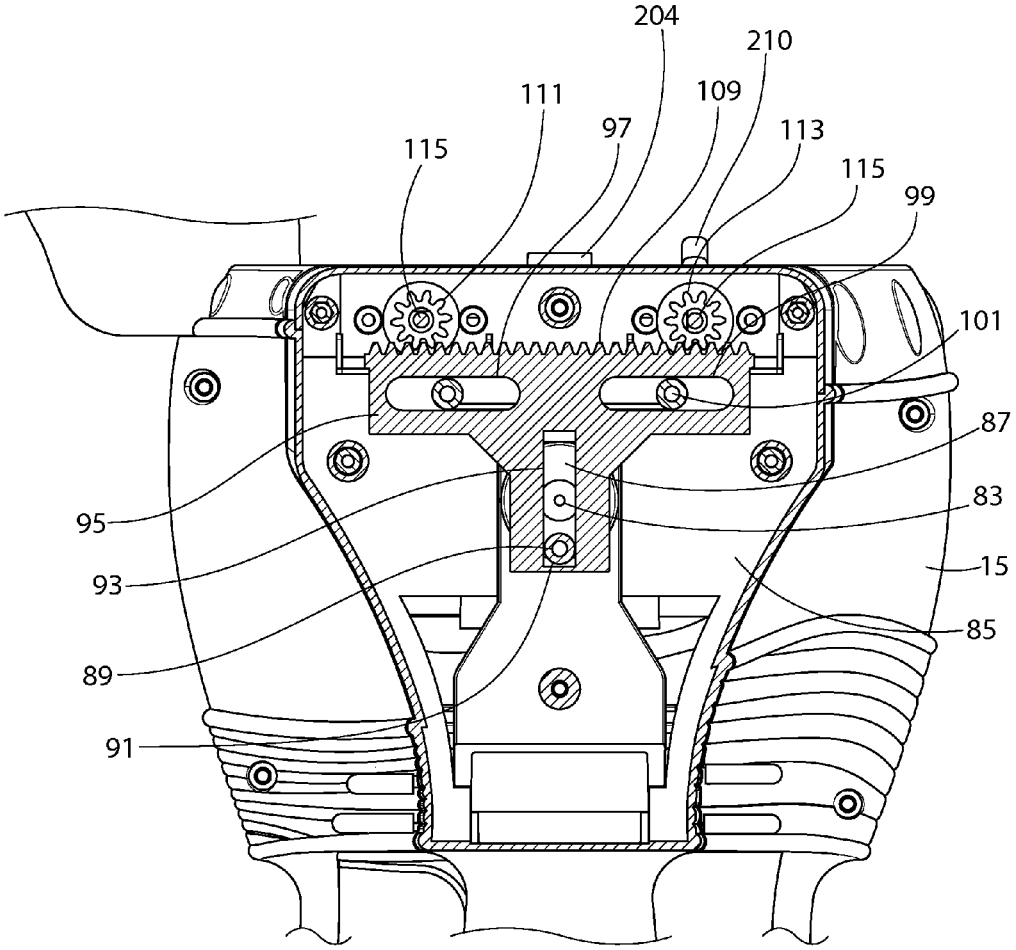
FIG. 6E is a sectional view of the bubble generating apparatus along the lines VIE-VIE of FIG. 5.

Turning back to the motor 39, the second drive shaft 43 extends downward and has a motor shaft gear 69 affixed to the end. This gear 69 is used to drive actuation of the first and second pivot arms 210, 230 for bubble generation. The gear mechanism for actuating the first and second pivot arms 210, 230 is shown in FIGS. 6D and 6E. A gear box 71 houses a series of gears 73, ending in a driving gear 75 affixed to the end of a secondary shaft 77. These gears 73 and the driving gear 75 are operationally coupled to the motor shaft gear 69. The gears 73 are configured to step-down the rotational rate of the motor shaft gear 69, so that the secondary shaft 77 is rotated at reduced rate as compared to the second drive shaft 43. The amount of rotational step-down may vary and is a matter of design choice. The secondary shaft 77 includes another gear 79 at its top end, and this gear 79 drives another gear 81 (which may be a face gear, a crown gear, or the like) coupled to a horizontal shaft 83, which passes through an inner wall 85 of the upper body housing 15 and is coupled to a wheel 87. As shown in FIG. 6E, the wheel 87 includes another axle 89, offset on the wheel 87 from the horizontal shaft 83, and a captive cylinder 91 is disposed on the axle 89. The captive cylinder 91 may rotate with the axle 89, or it may rotate independently of the axle 89. Rotation independent of the axle should provide a longer lifespan for the materials. The captive cylinder 91 engages the vertical slot 93 of a T-shaped plate 95. Two horizontal slots 97, 99 in the T-shaped plate 95 each engage stationary posts 101, 103. Each stationary post may include a captive cylinder configured to rotate about the post, to reduce wear on the parts. Engagement of the slots 97, 99 and the posts 101, 103, along with engagement of the vertical slot 93 with the retainer 91, serves to impart a linear oscillating motion to the T-shaped plate 95, oscillating it between two extreme positions from left to right.

Figure 6F:
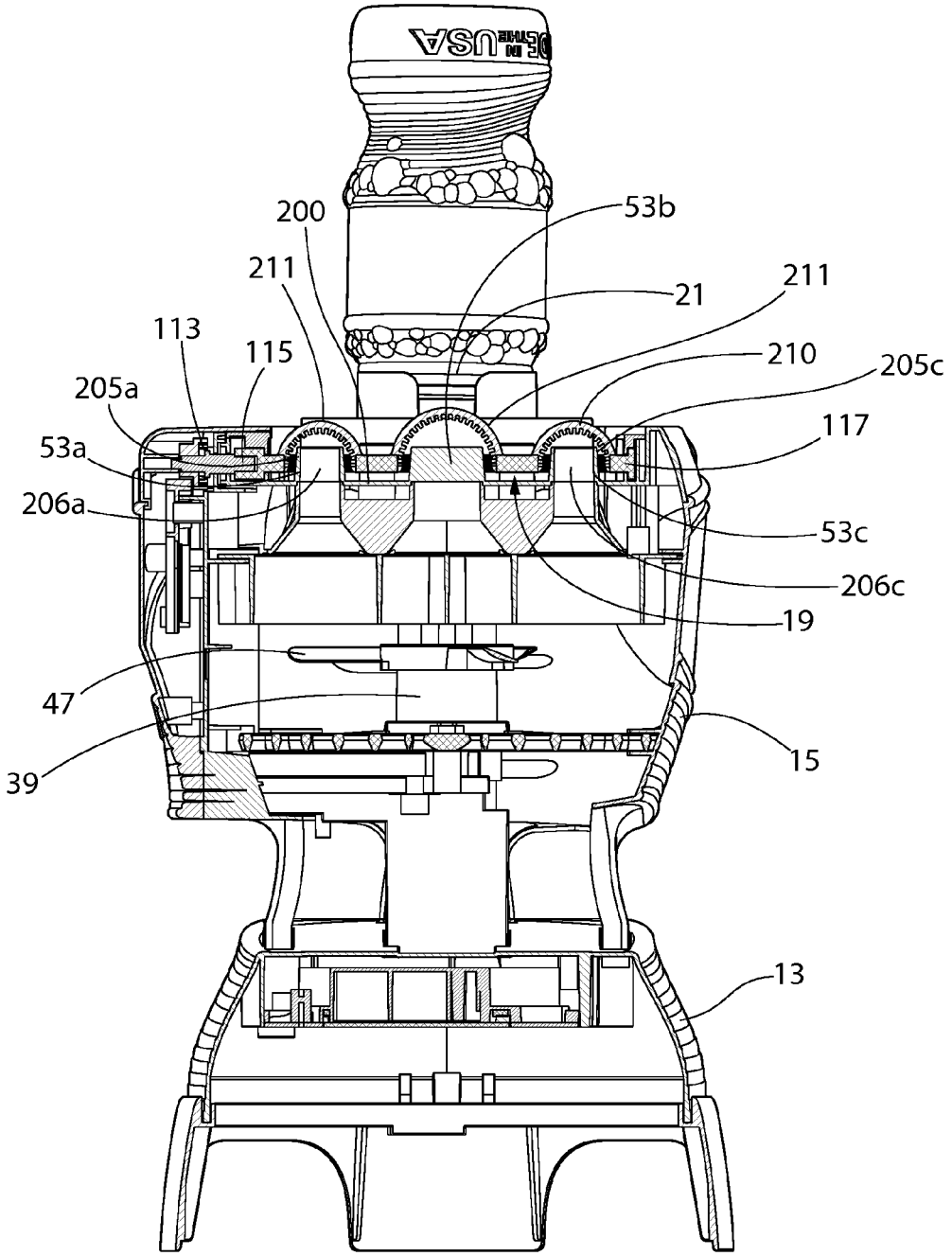
FIG. 6F is a sectional view of the bubble generating apparatus along the lines VIF-VIF of FIG. 4.

The T-shaped plate 95 further includes a gear rack 109, which engages each of two driven gears 111, 113 in a rack-and-pinion configuration. Each of the two driven gears 111, 113 are coupled by an axle 115 to the first and second pivot arms 210, 230, one of which is shown in FIG. 6F, through one side of the liquid tray 19. The other end 117 of each of the first and second pivot arms 210, 230 is coupled to an opposite side of the liquid tray 19. The back-and-forth motion in the T-shaped plate 95 causes the first and second pivot arms 210, 230 to oscillate through an angle of about 180° about an axle that is at a different orientation as compared to the axle of the motor driving the action. At the extreme ends of the pivot action, when bubble solution is present in the liquid tray 19 above a predetermined level, each of the first and second pivot arms 210, 230 is at least partially submersed in the bubble solution.

When multiple pivot arms are included with the apparatus, they may be coupled to respective driven gears so that the various arms move synchronously, or if preferred, they may be made to pivot asynchronously, i.e. each pivot arm is at a different angle of its respective pivot cycle at any given point in time. Alternatively, the gearing may be designed such that one pivot arm oscillates at a different speed compared to another pivot arm. Thus, several alternative arrangements for driving the one or more pivot arms are possible in different embodiments.

Referring now to FIGS. 6A and 7A-7C concurrently, operation of the bubble generating apparatus 11 will be described. To start operation, bubble solution 300 may be poured directly into the liquid tray 19 or bubble solution 300 may be dispensed into the liquid tray 19 via a gravity feed process. Specifically, in the exemplified embodiment a container or bottle 21 of the bubble solution is positioned inverted onto the reservoir receptacle 25. Conventional bottles in which bubble solution is sold on the market include a protective covering such as a film or the like adhered over the bottle opening and a cap screwed onto the top of the bottle over the protective covering. The reservoir receptacle 25 may include an upward-extending projection 59, which has an upper edge 61 that is shaped and configured to pierce the protective covering on the typical bottle available on the market. Thus, when the typical bottle of bubble solution has the cap removed, is inverted, and the top of the bottle is inserted into the reservoir receptacle 25, the upper edge 61 of the projection 59 will pierce the protective covering and allow bubble solution 300 to flow into the liquid tray 19. By positioning the bottle 21 and piercing the protective cover in this manner, the bottle 21 is configured as a gravity feeder for the bubble solution into the liquid tray 19. The bubble solution flows out of the bottle 21 and into the liquid tray 19, and when the level of the bubble solution 300 in the liquid tray 19 rises above the opening 63 of the bottle 21, the bubble solution stops flowing out of the bottle 21, due to the bottle 21 being an enclosed structure with only the one opening 63.

Figure 7A:
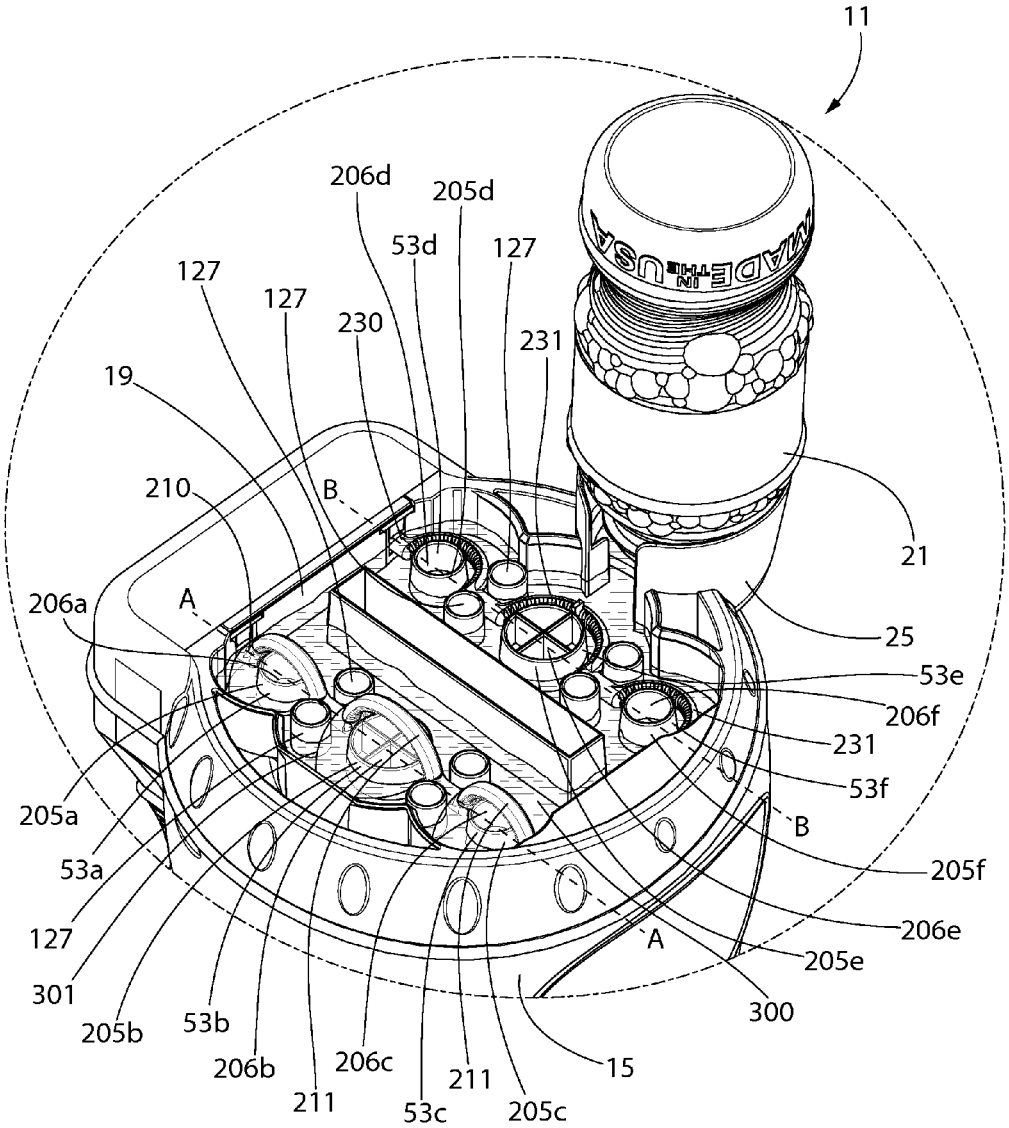
FIG. 7A is a close-up view of area VIIA of FIG. 1, wherein the pivot arms are in a first position.
Figure 7B:
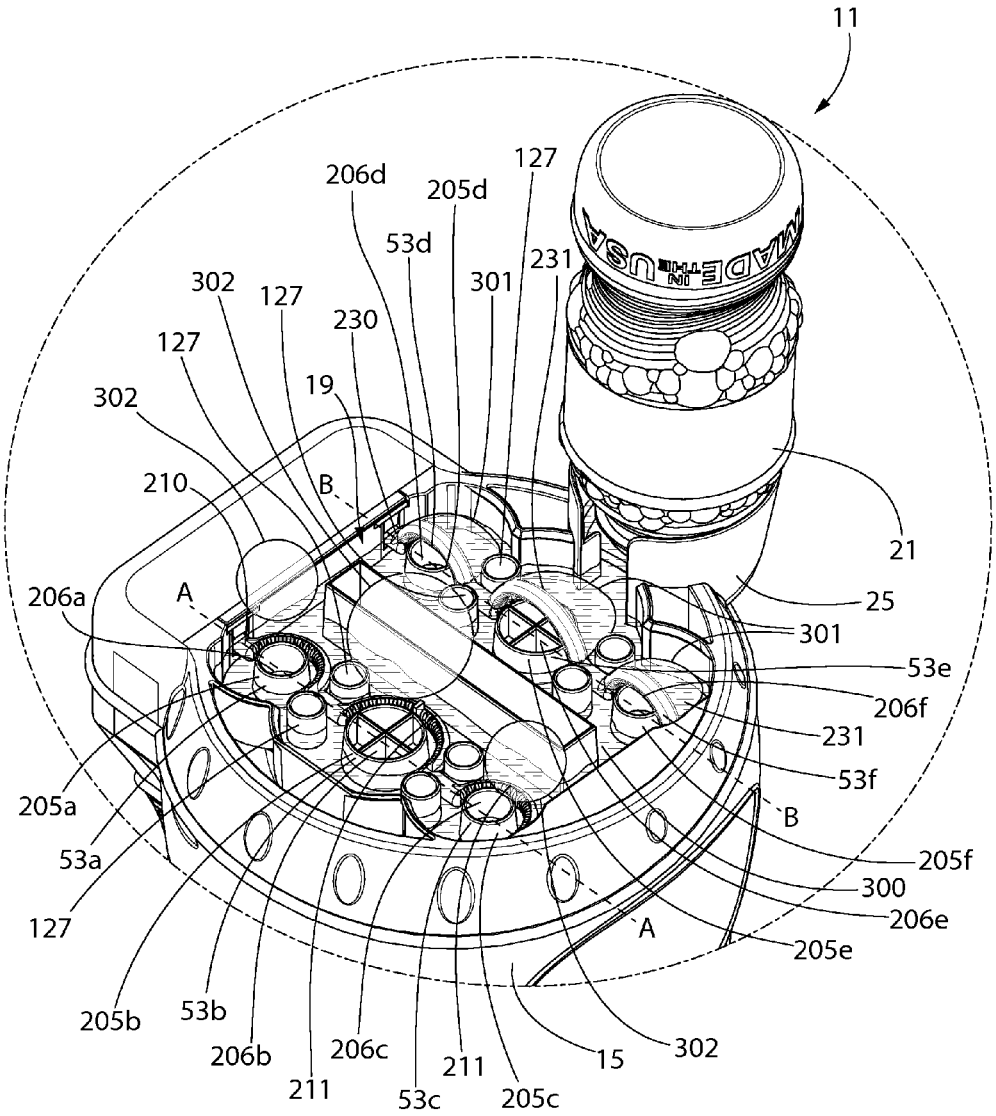
FIG. 7B is a close-up view of area VIIA of FIG. 1, wherein the pivot arms are in a second position.
Figure 7C:
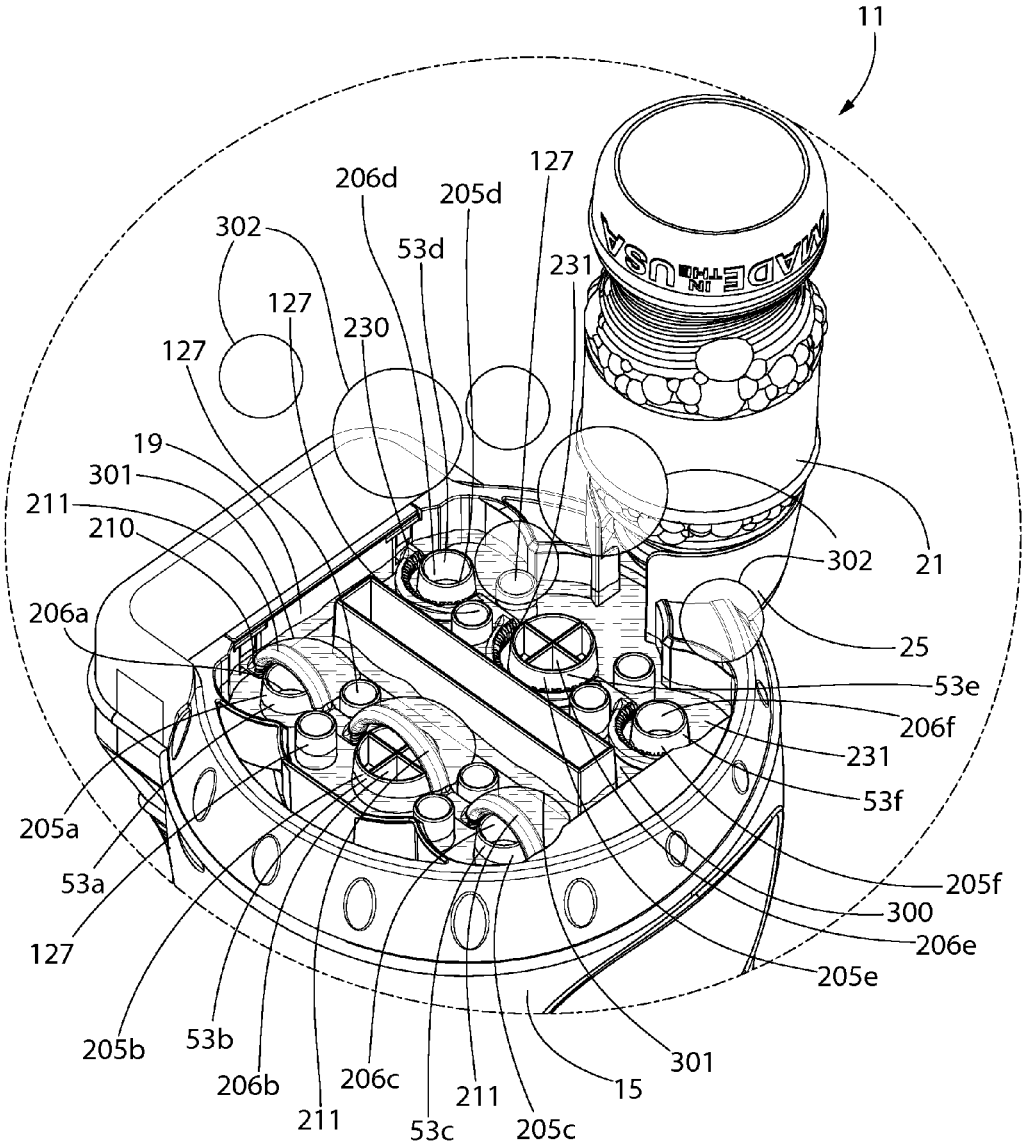
FIG. 7C is a close-up view of area VIIA of FIG. 1, wherein the pivot arms are in a third position.

Referring now to FIGS. 7A-7C concurrently, once the bubble solution 300 is dispensed from the bottle 21 into the liquid tray 19, bubbles may be generated by air blowing through the bubble forming ports 53*a-f* and actuation (pivoting) of the first and second pivot arms 210, 230. Specifically, as discussed above upon powering on the bubble generating apparatus 11, the motor 39 will begin to rotate, which in turn will cause the air flow generator 47 to generate an air stream through the openings 206*a-f* in the bubble forming ports 53*a-f* and through the openings 130 in the air ports 127. At the same time, the motor 39 will cause the first pivot arm 210 to pivot 180° about the first axis A-A in a back-and-forth/oscillatory manner and the motor 39 will cause the second pivot arm 230 to pivot 180° about the second axis B-B in a back-and-forth/oscillatory manner.

The movement and operation of the first and second pivot arms 210, 230 is the same and will be described herein below with reference to FIGS. 7A-7C and the second pivot arm 230, it being understood that the same description is applicable to the first pivot arm 210 (although movement of the first and second pivot arms 210, 230 can be asynchronous, synchronous, at the same or different speeds, or the like as noted herein above). In FIG. 7A, the second pivot arm 230 is in a first position in which the bubble generating members 231 are in contact with the bubble solution 300 in the liquid tray 19. Furthermore, in the first position the concave inner surfaces of the bubble generating members 231 are adjacent to and facing a first portion of the upstanding wall 205*a-f* of one of the bubble forming ports 53*a-f*.

The second pivot arm 230 rotates/pivots about the second axis B-B and arrives at a second position which is illustrated in FIG. 7B. In the second position, the concave inner surface of the bubble generating members 231 are adjacent to and facing the top opening 206*a-f* of the bubble forming ports 53*a-f*. In this second position, the concave inner surfaces of the bubble generating members 231 are positioned above the top of the upstanding walls 205*a-f* of the bubble forming ports 53*a-f*. Furthermore, due to the cohesion properties of the bubble solution 300 and the ribs/channels on the inner surfaces of the bubble generating members 231, a portion of the bubble solution 300 remains coupled to the bubble generating members 231 and forms a film 301 of the bubble solution extending between the bubble solution 300 in the liquid tray 19 and the bubble generating members 231.

Thus, it should be appreciated that the bubble generating members 231 form bubble wands, but not in the traditional sense. Specifically, the bubble generating members 231 do not form a shape having a contiguous perimeter, as are well-known in the art. Instead, each bubble generating member 231 serves the same function as a bubble wand, but instead of having a contiguous perimeter formed by the bubble generating member 231, each bubble generating member 231 uses the surface of the bubble solution 300 standing in the liquid tray 19 to "complete" the perimeter of the bubble generating member 231. With this configuration, as the bubble generating members 231 pivot up out of the bubble solution 300 standing in the liquid tray 19, the film 301 of the bubble solution 300 is formed between each of the bubble generating members 231 and the surface of the bubble solution 300 in the liquid tray 19.

As the bubble generating members 231 continue to pivot over the bubble forming ports 53*a-f*, each bubble generating member 231 draws the film 301 of the bubble solution 300 over the respective bubble forming port 53*a-f*, and with air being directed through the bubble forming ports 53*a-f* by the rotating air flow generator 47, a bubble 302 should form (actual bubble formation is highly dependent upon the conditions under which the apparatus 11 is used) as the bubble generating members 231, with the film 301 of the bubble solution 300 coupled/adhered thereto, pass over the bubble forming ports 53*a-f*.

Referring to FIG. 7C, the second pivot arm 230 is in a third position in which the concave inner surfaces of the bubble generating members 231 are adjacent to and facing a second portion of the upstanding walls 205*a-f* of the bubble forming ports 53*a-f*. After reaching the position depicted in FIG. 7C, the second pivot arm 230 begins to pivot back from the direction that it came. Specifically, after reaching the third position, the second pivot arm 230 will pivot to the second position depicted in FIG. 7B, and then to the first position depicted in FIG. 7A. This approximately 180° back and forth oscillation will continue repeatedly while the bubble generating apparatus 11 is operating and bubbles 302 will continue to form as the bubble generating members 211, 231 of the first and second pivot arms 210, 230 continue to carry a film 301 of the bubble solution 300 over the bubble forming ports 53*a-f*. Furthermore, as noted above the air flowing through the air ports 127 may cause a turbulent flow of the bubbles 302 after creation of the same to create a desired floating aesthetic of the bubbles 302.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed:

1. A bubble generating apparatus comprising:

a housing comprising a liquid tray defined by a floor and a sidewall extending upwardly from the floor;

a motor;

an air flow generator operably coupled to the motor to generate an air stream;

a plurality of bubble forming ports located in the liquid tray which forms a first linear array of bubble forming ports on a first side of the liquid tray and a second linear array of bubble forming ports on a second side of the liquid tray, each of the bubble forming ports comprising an upstanding wall extending upwardly from the floor of the liquid tray and having an inner surface that surrounds an opening, an outer surface, and a top surface extending between the inner and outer surfaces, the inner, outer, and top surfaces of the upstanding wall of each of the bubble forming ports being a continuous surface, the upstanding wall of each of the bubble forming ports circumferentially surrounding the opening to prevent bubble solution retained in the liquid tray from entering into the opening of the bubble forming port, the air flow generator positioned to direct the air stream through the openings of the plurality of bubble forming ports;

a first pivot arm located within the liquid tray and operably coupled to the motor to pivot the first pivot arm about a first axis that intersects each of the bubble forming ports of the first linear array, the first pivot arm extending between each of the bubble forming ports of the first linear array and comprising a plurality of bubble generating members, each of the bubble generating members at least partially surrounding the outer surface of the upstanding wall of a respective one of the bubble forming ports in the first linear array, each of the bubble generating members being semicircular and having a concave inner surface and a convex outer surface, the concave inner surface of each of the bubble generating members having ribs or channels thereon to assist the bubble generating members in carrying bubble solution, the concave inner surfaces of the bubble generating members being located adjacent to and facing the outer surface of the upstanding wall of the respective one of the bubble forming ports, each of the bubble generating members passing over the top surface of the respective one of the bubble forming ports during pivoting of the first pivot arm about the first axis to generate bubbles from the bubble solution retained in the liquid tray; and a second pivot arm located within the liquid tray and operably coupled to the motor to pivot the second pivot arm about a second axis that intersects each of the bubble forming ports of the second linear array, the second pivot arm extending between each of the bubble forming ports of the second linear array and comprising a plurality of bubble generating members, each of the bubble generating members at least partially surrounding the outer surface of the upstanding wall of a respective one of the bubble forming ports in the second linear array, each of the bubble generating members being semicircular and having a concave inner surface and a convex outer surface, the concave inner surface of each of the bubble generating members having ribs or channels thereon to assist the bubble generating members in carrying bubble solution, the concave inner surfaces of the bubble generating members being located adjacent to and facing the outer surface of the upstanding wall of the respective one of the bubble forming ports, each of the bubble generating members passing over a respective one of the bubble forming ports in the second linear array during pivoting of the second pivot arm about the second axis to generate bubbles from the bubble solution retained in the liquid tray; and wherein the first axis is substantially parallel to and laterally spaced apart from the second axis in an arrangement such that the first and second axes are not coaxial with each other.

2. The bubble generating apparatus of claim 1 wherein the floor of the liquid tray is exposed.

3. The bubble generating apparatus of claim 1 wherein at least one of the bubble forming ports comprises an air flow guide that is coupled to the inner surface of the upstanding wall at two or more different locations to divide the opening of the at least one of the bubble forming ports into a plurality of openings.

4. The bubble generating apparatus of claim 1, wherein the first pivot arm pivots back and forth approximately 180° about the first axis and the second pivot arm pivots back and forth approximately 180° about the second axis.

5. The bubble generating apparatus of claim 1, wherein the first pivot arm repetitively pivots about the first axis by the motor between: (1) a first position in which the concave inner surface of each of the bubble generating members surrounds and is adjacent to a first portion of the outer surface of the upstanding wall of the respective one of the bubble forming ports; (2) a second position in which the concave inner surface of each of the bubble generating members is positioned above and faces the top surface of the upstanding wall and the opening of the respective one of the bubble forming ports; and (3) a third position in which the concave inner surface of each of the bubble generating members surrounds and is adjacent to a second portion of the outer surface of the upstanding wall of the respective one of the bubble forming ports.

6. The bubble generating apparatus of claim 1, wherein the first pivot arm comprises at least three of the bubble generating members, and wherein adjacent ones of the bubble generating members of the first pivot arm are coupled together by an arm section of the first pivot arm, the arm sections of the first pivot arm being located on the first axis and the bubble generating members of the first pivot arm being offset from the first axis.

7. The bubble generating apparatus of claim 6, wherein each of the bubble generating members of the first pivot arm passes over a different one of the bubble forming ports during pivoting of the first pivot arm about the first axis to generate multiple bubbles simultaneously with the first pivot arm.

8. The bubble generating apparatus of claim 6, further comprising a pair of air ports located in the liquid tray and positioned between adjacent ones of the plurality of bubble forming ports, the air flow generator positioned to direct the air stream through the air ports, each of the air ports comprising an air opening surrounded by an air wall that extends upwardly from the floor of the liquid tray, and wherein one of the arm sections of the first pivot arm is located between a first air port and a second air port of the pair of air ports.

9. The bubble generating apparatus of claim 1, wherein the upstanding wall of each of the bubble forming ports is entirely spaced apart from the sidewall of the housing.

10. A bubble generating apparatus comprising:

a housing comprising a liquid tray defined by a floor and a sidewall extending upwardly from the floor;

a motor;

an air flow generator operably coupled to the motor to generate an air stream;

first and second bubble forming ports located in the liquid tray, the first bubble forming port comprising a first upstanding wall extending upwardly from the floor of the liquid tray and a first opening, the first upstanding wall having a continuous outer surface, a continuous top surface, and a continuous inner surface that surrounds the first opening, and the second bubble forming port comprising a second upstanding wall extending upwardly from the floor of the liquid tray and a second opening, the second upstanding wall having a continuous outer surface, a continuous top surface, and a continuous inner surface that surrounds the second opening, the air flow generator positioned to direct the air stream through the first and second openings of the first and second bubble forming ports, the first and second upstanding walls circumferentially surrounding the first and second openings respectively to prevent a bubble solution retained in the liquid tray from entering into the first and second openings; and a first pivot arm located within the liquid tray and operably coupled to the motor to repetitively pivot the first pivot arm back and forth approximately 180° about a first axis;

the first pivot arm comprising:

a first bubble generating member comprising an inner surface having ribs or channels thereon to assist the first bubble generating member in carrying the bubble solution, the inner surface of the first bubble generating member positioned adjacent to, at least partially surrounding, and facing the outer surface of the first upstanding wall and passing over the top surface of the first upstanding wall of the first bubble forming port during pivoting of the first pivot arm about the first axis to generate bubbles from the bubble solution retained in the liquid tray; and a second bubble generating member operably coupled to first bubble generating member by a first arm section of the first pivot arm, the second bubble generating member comprising an inner surface having ribs or channels thereon to assist the second bubble generating member in carrying the bubble solution, the inner surface of the second bubble generating member positioned adjacent to, at least partially surrounding, and facing the outer surface of the second upstanding wall and passing over the top surface of the second upstanding wall of the second bubble forming port during pivoting of the first pivot arm about the first axis to generate bubbles from the bubble solution retained in the liquid tray.

11. The bubble generating apparatus of claim 10, wherein the first and second upstanding walls have circular cross-sectional shapes, and wherein each of the first and second bubble generating members has a semi-circular shape such that the inner surfaces of the first and second bubble generating members facing the outer surface of the first and second upstanding walls are concave.

12. The bubble generating apparatus of claim 10, wherein the liquid tray comprises a first section and a second section that are partially separated from one another by a divider wall that extends upwardly from the floor of the liquid tray, wherein the divider wall is spaced apart from the sidewall defining the liquid tray so that the first and second sections of the liquid tray are in fluid communication with each other.

13. The bubble generating apparatus of claim 12, wherein the first pivot arm is located within the first section of the liquid tray and further comprising a second pivot arm located within the second section of the liquid tray, the second pivot arm operably coupled to the motor to repetitively pivot the second pivot arm back and forth approximately 180° about a second axis that is substantially parallel to the first axis.

14. The bubble generating apparatus of claim 10, further comprising an air port located in the liquid tray and fluidly coupled to the air stream generated by the air flow generator, the air port comprising an upstanding wall extending upwardly from the floor of the liquid tray and an opening, and wherein the air port is positioned between the first and second bubble forming ports.

15. The bubble generating apparatus of claim 14, wherein the first arm section extends between the first and second bubble generating members along the first axis, and wherein an axis that is transverse to the first axis intersects the first arm section and the air port.

16. The bubble generating apparatus of claim 14, wherein the first and second bubble forming ports are aligned along the first axis and wherein the air port is offset from the first axis.

* * * * *